United States Patent [19]

Porter, Jr.

[11] 3,996,405

[45] Dec. 7, 1976

[54] PRESSURE-SENSITIVE RECORD MATERIAL

[75] Inventor: Erland C. Porter, Jr., Appleton, Wis.

[73] Assignee: NCR Corporation, Dayton, Ohio

[22] Filed: Nov. 8, 1974

[21] Appl. No.: 522,001

Related U.S. Application Data

[63] Continuation of Ser. No. 326,361, Jan. 24, 1973, abandoned.

[52] U.S. Cl. ..... 428/307; 252/316; 260/343.3 R; 260/335; 427/145; 427/150; 428/323; 428/327; 428/537

[51] Int. Cl.[2] ..... B41M 5/12

[58] Field of Search ..... 260/343.3, 335; 428/307, 323, 488, 537; 282/27.5, 28 R; 427/150, 145; 252/316

[56] References Cited

UNITED STATES PATENTS

| | | | |
|---|---|---|---|
| 3,491,111 | 1/1970 | Lin | 260/315 |
| 3,627,581 | 12/1971 | Phillips | 252/316 |
| 3,663,256 | 5/1972 | Miller et al. | 282/27.5 |
| 3,672,935 | 1/1972 | Miller et al. | 282/27.5 |
| 3,681,390 | 8/1972 | Lin | 260/335 |
| 3,723,156 | 3/1973 | Brockett et al. | 282/27.5 |
| 3,732,120 | 5/1973 | Brockett et al. | 428/307 |
| 3,836,383 | 9/1974 | Kiritani et al. | 252/316 X |

*Primary Examiner*—Thomas J. Herbert, Jr.
*Attorney, Agent, or Firm*—E. Frank McKinney; Robert J. Shafer

[57] ABSTRACT

Record material comprising paper sheet material coated with liquid-containing microcapsules wherein the liquid contents comprise ethyldiphenylmethane. Said liquid is associated on the record material with at least two color-producing reactants, at least one of which is soluble in said liquid. The encapsulated liquid is associated with the reactants by either being in close proximity to both reactants or by having one of the reactants dissolved therein and being in close proximity to the other. Of the color-producing reactants, one is a chromogenic dye-precursor and one is a coreactant material capable of developing the color of the chromogenic dye-precursor when the two reactants are brought into reaction contact by rupture of the capsule walls that contain said liquid.

3 Claims, No Drawings

PRESSURE-SENSITIVE RECORD MATERIAL

This is a continuation of application Ser. No. 326,361, filed Jan. 24, 1973, now abandoned.

This invention provides record material comprising paper sheets coated with isolated liquid droplets, comprising ethyldiphenylmethane. Said isolated liquid droplets are associated on the record material with at least two color-producing reactants, at least one of which is soluble in said liquid. The liquid is associated with the reactants by either being in close proximity to both reactants or by having one of the reactants dissolved therein and being in close proximity to the other. Of the color-producing reactants, one is a chromogenic dye-precursor and one is a coreactant material capable of developing the color of the chromogenic dye-precursor when the two reactants are brought into reaction contact by rupture of the isolating medium. Isolation of the liquid droplets is preferably accomplished by encapsulation of the droplets with pressure-rupturable, solid, polymeric, film material.

In the art of making pressure-sensitive record material of the type described which includes liquid-containing-microcapsules, successful commercial embodiments have made use of Crystal Violet Lactone (hereinafter called CVL) as the chromogenic dye-precursor material, an acidic coreactant material such as attapulgite clay or an oil-soluble, para-substituted-phenol-aldehyde novolak resin, and a liquid solvent that is at least in part isopropyl-biphenyl as disclosed in U.S. Pat. No. 3,627,581 to Paul S. Phillips, Jr. Isopropyl-biphenyl has a low vapor pressure and good solvent power and is readily retained by gelatin films (the most widely used capsular wall material). Isopropyl-biphenyl has therefore served well as the solvent in pressure-sensitive record material systems of the type disclosed.

Ethyldiphenylmethane has been found to provide better print intensities and better fade resistance than the previously known isopropyl-biphenyl.

For purposes of this invention, ethyldiphenylmethane means a compound or a mixture of compounds of the structure:

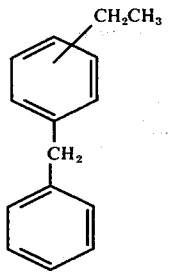

in which the ethyl group may be attached to the benzene ring at the ortho, meta, or para positions. Production methods commonly used produce a mixture of at least two of the three possible ethyldiphenylmethanes. Commercially produced quantities of ethyldiphenylmethane generally include impurities of greater benzyl content, namely dibenzylethylbenzene and polybenzylethylbenzene, the latter being substantially all tribenzylethylbenzene. The so-described impurities may be represented by the following structure:

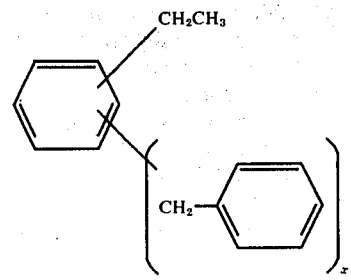

where $x$ is 2 or 3. Although ethyldiphenylmethane is the preferred solvent, formulations from commercially produced ethyldiphenylmethane which are operable in the record material of this invention can include amounts by weight of dibenzylethylbenzene of up to about 25% and polybenzylethylbenzene of up to about 7%.

Nonhalogenated diluent oils may be added to the ethyldiphenylmethane without adversely affecting the performance of the record systems made therewith. High-boiling aliphatic hydrocarbons and $C_{10}$–$C_{15}$-alkylbenzenes have been used successfully as ethyldiphenylmethane diluents. Since these diluents are generally cheaper than ethyldiphenylmethane, their use is in the interest of economy. Solubility of the chosen colorless, chromogenic dye-precursor material in the chosen diluent dictates the maximum amount of such diluent which can be used. If the ethyldiphenylmethane is to be diluted with other oils, the diluted ethyldiphenylmethane should be capable of dissolving at least one percent and preferably 1.5 percent or more of the chosen dye-precursor. When CVL is the chosen dye-precursor, the preferred diluents are saturated aliphatic hydrocarbon oils (with a distillation range in the range of 320° to 550° F.), which may be added to ethyldiphenylmethane to make up about one-third of the total weight of the CVL solvent, and $C_{11}$–$C_{12}$-alkylbenzene which may be used to the extent of two-thirds of the total weight of said solvent.

Of course, in addition to the preferred diluent hydrocarbon oils discussed above, many oils known to the art as useful internal phase solvents, may be used as a diluent herein for the ethyldiphenylmethane provided they are not halogenated, are at least partially miscible with ethyldiphenylmethane so as to give a single phase in the proportions used, and are not chemically reactive with ethyldiphenylmethane or the other components of the marking liquid. For instance, low molecular weight aromatic hydrocarbons such as xylene and toluene, organic acid esters such as fatty acid esters and phthalic acid esters, phosphate esters such as dibutylphosphate, dioctyl phosphate and discresylphosphate, and ethers such as diphenyl oxide are all eligible for use as diluent oils.

Dye-precursor materials in addition to CVL which may be dissolved in ethyldiphenylmethane for encapsulation purposes include any colorless, chromogenic dye-precursor materials such as those disclosed in U.S. Pat. No. 3,672,935 to Robert E. Miller and Paul S. Phillips, Jr., and dialkylamino fluoran chromogenic compounds such as disclosed in U.S. Pat. No. 3,681,390 to Chao-Han Lin. Examples of these materials are 2′-(2-carboxyanilino)-6′-diethylaminofluoran; 2′-(2-carbomethoxyanilino)-6′-diethylaminofluoran; 2′-anilino-6′-diethylaminofluoran; 2′-(3-carboxy-2-naphthylamino)-6′-diethylaminofluoran; 2′-(3-carbomethoxy-2-naphthylamino)-6′-diethylaminofluoran; 2′-(2-carboxyanilino)-6′-diethylamino-3′-methylfluoran; 2′-(2-carbomethoxyaniline)-6′-diethylamino-3′-methylflouran; 2′-anilino-6′-diethylamino-3′-methylfluoran; 2′-(3-carboxy-2-naphthylamino)-6′-diethylamino-3′-methylfluoran; 2′-(3-carbomethoxy-2-naphthylamino)-6′-diethylamino-3′-methylfluoran; 5-(2-carboxyanilino)-2′-chloro-6′-diethylamino-3′-methylfluoran; and 6-(2-carboxyanilino)-2′-chloro-6′-diethylamino-3′-methylfluoran.

Examples of phenol-aldehyde resins which can be used as coreactant materials to develop the color of the dye-precursor materials are those disclosed in the aforementioned U.S. Miller-Phillips patent, the oil-soluble para-substituted-phenol-formaldehyde novolak resins generally being preferred. Other useful phenolic resins are disclosed in U.S. Pat. No. 3,663,256 to Robert E. Miller and Bruce W. Brockett.

Still further useful phenol aldehyde resins are oil-soluble metal salts of phenol-aldehyde novolak resins, for example, the zinc salt of para-octylphenol-formaldehyde resin, disclosed in U.S. patent application Ser. No. 152,830, filed June 14, 1971, now U.S. Pat. No. 3,732,120 in the names of Bruce W. Brockett, Robert E. Miller and Mary L. Hinkle. Each of an oil-soluble, water-insoluble, metal salt such as zinc(II) 2-ethylhexanoate and an oil-soluble phenol-aldehyde novolak resin, for example, a para-phenylphenol-formaldehyde resin, may be provided on the same sheet as coreactant materials, as disclosed in U.S. patent application Ser. No. 153,079, filed June 14, 1971, now U.S. Pat. No. 3,723,156 in the names of Bruce W. Brockett, Robert E. Miller and Mary L. Hinkle.

Capsule-wall materials and capsule manufacture are not critical to this invention. Suitable capsules may be made according to the procedures taught in U.S. Pat. No. 2,800,457 (July 23, 1957), U.S. Pat. No. 2,800,458 (July 23, 1957) which became U.S. Pat. No. Re. 24,899 (Nov. 29, 1960) and U.S. Pat. No. 3,041,289 (June 26, 1962). Other methods of isolating the marking droplets are also applicable here, such as entrapment of the droplets in a dried emulsion film.

Suitable procedures for making capsule-coated record sheets are taught in U.S. Pat. No. 2,711,357 (June 21, 1955), U.S. Pat. No. 2,712,507 (July 5, 1955), U.S. Pat. No. 2,730,456 (Jan. 10, 1956) and in the previously cited U.S. Pat. No. 3,672,935 to Miller and Phillips. The various configurations, arrangements and locations of the solvent of this invention, the dye precursor, the coreactant materials, and the capsules which contain one or more of these components within two-sheet couplet record material or single sheet self-contained material are described in detail in the Miller-Phillips patent. Any such configuration can be employed for purposes of this invention.

The preparation and use of record material incorporating ethyldiphenylmethane is taught in detail in the following examples. All compositional parts or percent composition figures herein are parts by weight or weight percents unless otherwise indicated.

EXAMPLE 1

Encapsulation of CVL-Ethyldiphenylmethane Solution

A solution of CVL, 1.7 percent, in ethyldiphenylmethane, was chosen for use as the internal phase of the capsules. The following formulation was emulsified in a Waring "Blendor" at 55° C. to give internal phase droplets of 4 microns diameter:

150 grams of internal phase
150 grams of 10 percent gelatin at pH 6.5
62 grams of deionized water.

Coacervation was accomplished by addition to the above emulsion, under continued agitation at 55° C., of 100 grams of 10 percent gum arabic solution, 10 grams of 5 percent PVM/MA, poly(vinyl methyl ether/maleic anhydride) and 600 grams of deionized water. With continued agitation and temperature maintenance, the mixture was treated with sufficient 20 percent sodium hydroxide solution to adjust the pH to 9.0 and then with 12.5 milliliters of 14 percent acetic acid, dropwise. The mixture was then cooled slowly, with continued agitation, to 12° C. and treated with 7.5 milliliters of 25 percent glutaraldehyde. After 4 hours of stirring, 12.0 milliliters of basic 5 percent PVM/MA (pH 9.0) is added, dropwise, to the mixture which is then stirred for an additional 2.5 hours while it gradually warms, up to about room temperature. The pH of the mixture, which is now a suspension of microcapsules, was finally adjusted to 9.5 with 20 percent sodium hydroxide. The microcapsules may be used as is, as an aqueous suspension or they may be isolated by filtration and air-dried.

EXAMPLE 2

Encapsulation of CVL-Ethyldiphenylmethane-hydrocarbon oil

According to the procedure of Example 1, microcapsules were made wherein a 2:1 mixture of ethyldiphenylmethane and a saturated hydrocarbon oil (distillation range 370°–500° F.) was substituted for the ethyldiphenylmethane of that example.

EXAMPLE 3

Encapsulation of CVL-Ethyldiphenylmethane-alkylbenzene

According to the procedure of Example 1, microcapsules were made wherein a 1:2 mixture of ethyldiphenylmethane and a mono-$C_{11}$ to $C_{12}$-alkylbenzene was substituted for the ethyldiphenylmethane of that example.

EXAMPLE 4

Encapsulation of phenol-aldehyde resin solution

Generally following the method of Example 1, a 10 percent solution of para-phenylphenolformaldehyde novolak resin in a 2:1 mixture of ethyldiphenylmethane and xylene was encapsulated. The initial emulsion consisted of 180 grams of internal phase, 191 grams of 11 percent gelatin at pH 4.3 and 15.8 grams of deionized water. Coacervation was accomplished by the addition of 127 grams of 11 percent gum arabic solution, 135 grams of 5 percent PVM/MA and 817 grams of deionized water. In the final stages, 21 milliliters of 14 percent acetic acid, 10 milliliters of 25 percent glutaraldehyde, and 20 milliliters of basic 5 percent PVM/MA were added instead of the amounts specified in Example 1. The final stirring times were also changed: 16 hours following the glutaraldehyde addition and one hour following the final basic PVM/MA addition. The final adjustment of the pH to 9.5 was omitted.

EXAMPLE 5

Record Material Sheets Coated with the Capsules of Examples 1, 2 and 3

An aqueous coating slurry of the following composition was made up by stirring:

| | Parts (Wet) | Parts (Dry) |
|---|---|---|
| Capsules | 465 | 100 |
| Arrowroot Starch Granules | 24 | 24 |
| Cooked Cornstarch | 50 | 10 |
| Water | 41 | — |

Paper sheets were coated with the above slurry with a No. 15 Mayer rod to give a dried coating weight of about 3.5 pounds per ream (500 sheets, measuring 35 × 38 inches).

Coatings made with the capsules of Examples 1, 2 or 3 gave record material sheets that yielded intense blue marks when marked on against acid-sensitized receiving sheets. The test receiving sheets were standard commercial receiving sheets sensitized according to the teaching of the previously cited U.S. Pat. No. 3,663,256 to Miller-Brockett. The so-produced marks were more intense and provided better fade resistance (when exposed to light and air) than similar marks made with coated sheets having 2:1 isopropylbiphenyl-hydrocarbon oil as the capsular internal phase solvent for the CVL.

Capsules and capsule-coated sheets were made up according to Example 2 and this Example 5 and were compared quantitatively to sheets that were identical except that isopropylbiphenyl was substituted for the ethyldiphenylmethane of this invention. When marks of the same pressure were made on the two above-described capsule-coated sheets against receiving sheets (sensitized with para-phenylphenol-formaldehyde resin according to U.S. Pat. No. 3,672,935), the concentration of colored material developed on the receiving sheet by CVL in ethyldiphenylmethane was about 30 percent greater than that developed on the receiving sheet by CVL in isopropylbiphenyl.

Similar results were observed when the coated sheets bearing the capsules of Example 4 were used as the transfer sheet against a facing receiving sheet that had been sensitized by being dipped in an acetone solution of a colorless, chromogenic, dye-precursor and dried. Among the colorless, chromogenic, dye-precursor materials used in this test were CVL, Malachite Green Lactone, N-(2,5-dichlorophenyl)leucauramine, N-benzoylauramine, Methyl Red, 4-aminoazobenzene, methoxybenzoindolinospiropyran and Rhodamine B Lactam.

What is claimed is:

1. Record sheet material comprising paper coated with microcapsules containing droplets of an oil solution of base-reacting colorless chromogenic dye-precursor material wherein said oil comprises a mixture of at least about 70 percent, by weight, ethyldiphenylmethane, not more than about 25 percent, by weight, dibenzylethylbenzene and not more than about 7 percent, by weight, polybenzylethylbenzene, and a diluent selected from the group consisting of a high-boiling saturated aliphatic hydrocarbon oil in an amount up to about one-third of the total weight of the oil and mono-$C_{10}$ to $C_{15}$-alkylbenzene in an amount up to about two-thirds of the total weight of the oil; and with an oil-soluble, acid-reacting zinc salt of phenol-formaldehyde novolak resin capable of producing color in said dye-precursors when brought into reactive contact therewith.

2. The record sheet material of claim 1 in which the dye-precursor material comprises Crystal Violet Lactone.

3. The record sheet material of claim 1 in which the dye-precursor material comprises a dialkylaminofluoran.

* * * * *